United States Patent [19]

Perrino

[11] 4,013,237

[45] Mar. 22, 1977

[54] WINDING APPARATUS WITH TAILING DEVICE

[75] Inventor: Thomas William Perrino, Johnston, R.I.

[73] Assignee: Leesona Corporation, Warwick, R.I.

[22] Filed: Oct. 6, 1975

[21] Appl. No.: 620,213

[52] U.S. Cl. ..... 242/18 PW; 242/26.41

[51] Int. Cl.[2] ..... B65H 54/00; B65H 54/34

[58] Field of Search ..... 242/18 PW, 26.41, 26.43, 242/26.44, 27.1

[56] References Cited

UNITED STATES PATENTS

| | | | |
|---|---|---|---|
| 3,103,305 | 9/1963 | Heatherly | 242/18 PW |
| 3,408,011 | 10/1968 | Lenk et al. | 242/18 PW |
| 3,575,355 | 4/1971 | Ratti | 242/18 PW |
| 3,767,130 | 10/1973 | Perrins | 242/18 PW |

FOREIGN PATENTS OR APPLICATIONS

| | | | |
|---|---|---|---|
| 978,187 | 12/1964 | United Kingdom | 242/18 PW |

*Primary Examiner*—Richard C. Queisser
*Assistant Examiner*—Charles Gorenstein
*Attorney, Agent, or Firm*—Burnett W. Norton

[57] ABSTRACT

The present invention is directed to a method and apparatus for forming a tailing end of predetermined length and the resultant package formed thereby. The tailing device includes a conically shaped hub positioned on the outboard end of a drive roll and provided with a spiral groove in the outer surface. The groove runs from a terminal flat circular groove upwardly to the main cylindrical drive portion of the roll. Means are provided for moving a strand sequentially into contact with the flat circular groove to form a bunch on the package support and thereafter in contact with the spiral groove so as to print helically wound wraps of strand about the support prior to the initiation of winding the main body of strand on the package as by conventional traverse means. The width and number of turns the spiral groove makes along the extent of the hub regulates the length of usable tailing end that will be formed in the completed package. The formation of the tailing end is accomplished by positive mechanical means which are independent of changes in winding speed or tension and accordingly is able to repeatedly produce tailing ends of essentially equal length from package to package.

14 Claims, 14 Drawing Figures

WINDING APPARATUS WITH TAILING DEVICE

BACKGROUND OF THE INVENTION

Winding machines for winding packages of textile strand are old in the art and customarily may include a spindle on which a supporting package is mounted for free rotation by means of a drive roll adapted to engage the surface of the support and thereafter the main body of strand wound thereon so as to rotate the same. A traversing means including a guide for reciprocating the strand material axially of the support to wind the main body of yarn are also included. In the formation of such packages it is useful to provide a tailing end, i.e., a plurality of circumferential wraps of strand about one end of the package support outboard of the main body of strand formed thereon. The tailing end serves to provide a free unentangled length of strand which may be tied to a running length of strand or to another package in a creel as may be required in processing the strand. In this regard it is helpful that a predetermined length of tailing end be available for such tying operations.

Heretobefore the formation of a measured or minimum length of tailing end was generally accomplished by the correlation of strand speed with a mechanism to produce a time delay in which the required number of wraps may be made around the package support prior to the strand being caught by the guide of the traverse means for winding the main body of strand. Known devices based on this concept rely on precise timing and accordingly require either highly sophisticated expensive timing devices or produce tailing ends of undesirable varying lengths from package to package. Such devices have also been combined with a smooth conical tailing hub to better space the individual laps of the tailing end prior to winding of the main body of strand however inherent slippage across the hub enables spacing variations to occur.

SUMMARY OF THE INVENTION

It would thus be desirable to be able to produce tailing ends of repeatedly equal length from package to package and accordingly the primary object of the present invention is the provision of an apparatus and method of accomplishing such essentially equal tailing length production and the resultant package formed thereby.

Another object of the present invention is to provide a tailing apparatus for a winding machine wherein the length of the tailing end formed thereby is positively regulated by mechanical means unrelated to the speed or tension of the strand material and which repeatedly forms a tailing end of essentially equal length.

Another object of the present invention is the provision of a tailing means for a winding machine wherein a tailing hub of generally conical surface configuration is provided with an upwardly extending continuous spiral groove adapted for receipt of a running strand so as to print generally equidistant helically wound wraps of strand about the package driven thereby as the strand upwardly inwardly moves along such continuous groove.

A still further object of the present invention is to provide a tailing apparatus for a winding device wherein tailing ends of different lengths may be formed thereby by the substitution of a tailing hub having fewer or greater number of complete spiral turns therein.

Other objects, features and advantages of the invention will become apparent when the description thereof proceeds when considered in connection with the accompanying illustrated drawings.

DESCRIPTION OF THE PREFERRED EMBODIMENT

This invention relates to strand handling and, more particularly, to winding.

As used herein the term "package" means a body of strand wound so it may be readily moved from place to place. The term "body" means a main body of strand wound to form the package. The term "tailing end" means a portion of the strand extending from an end winding of the body. The term "bunch" means at least one and generally a plurality of strands wound about one end of a package support and connected to the tailing end. The term "strand" is employed in a general sense to apply to all kinds of strand material, either textile or otherwise.

Figure 1:
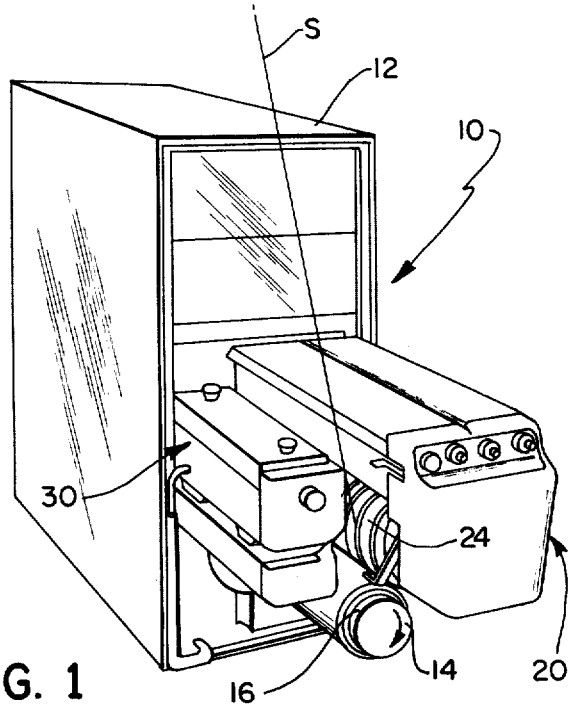
FIG. 1 is a perspective view of the overall winding machine incorporating the novel tailing mechanism.

Referring to the drawings and in particular, FIG. 1 thereof, a textile winding machine 10 commonly referred to as a take-up machine, is shown. The winding machine is adapted to wind strandular material S advancing from a source of supply such as a spinerette into a textile package P. The machine 10 includes a frame 12 on which a fixed position spindle 14 is mounted for rotation. The spindle 14 is further provided with conventional chuck means (not shown) for engaging and supporting a rotatable package support 16 upon which the package P is built.

Drive means 20 is mounted above said spindle and includes a housing 22 having an end plate 23 which cooperatively support a rotatable drum or bail member 24 in turn driven by suitable means (not shown). The package support 16 and the spindle 14 are driven by means of the rotating drum 24 which engages the periphery of the package support 16, and ultimately with the main body of strand progressively wound thereon, to thereby rotate the package P.

The machine further includes traversing means 30 having a housing 32 from which a barrel cam (not shown) of conventional type is mounted for rotation and which is provided with an endless helical groove (also not shown). Traverse means 30 further includes a follower (also not shown) engaged in the groove of the barrel cam and a traverse guide 34 best shown in FIG. 7 mounted on the outer end thereof which engages the advancing strand S for winding the main body of strand. As the barrel cam is rotated by motor means (not shown), the traverse guide 34 reciprocates from reversal point to reversal point of the grooved cam and accordingly serves to distribute the strand S along the package support 16 and package P which is formed thereon.

Both the drive means 20 and the traverse means 30 and their accompanying drive means may be mounted on a counterweighted carriage which moves upwardly as the package P being wound on the support 16 progressively increases in diameter and as more fully disclosed in co-pending application Ser. No. 620,173 entitled "Winding Apparatus" filed Oct. 6, 1975 and assigned to the subject assignee, the disclosure of which is hereby incorporated in this application.

Alternatively, the spindle 16 may be mounted for relative movement away from the drive means on a swingable or slidable frame support or guide in which case the drive means and traverse means would be mounted to the frame 12. It should be understood that the foregoing drive and package support means and their particular interrelation form no part of the present invention and that the term "frame" as used herein includes movable carriage means and other support mechanisms.

Figure 12:
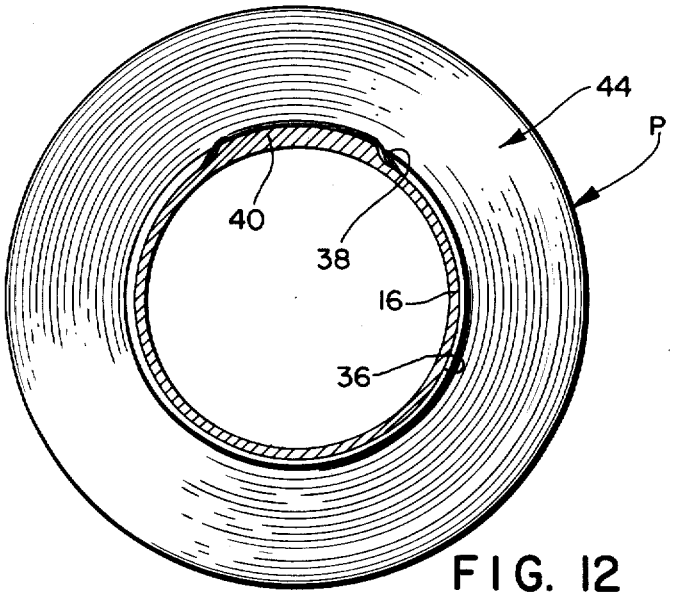
FIG. 12 is the sectional view of the package taken along the line 12—12 of FIG. 11.
Figure 13:
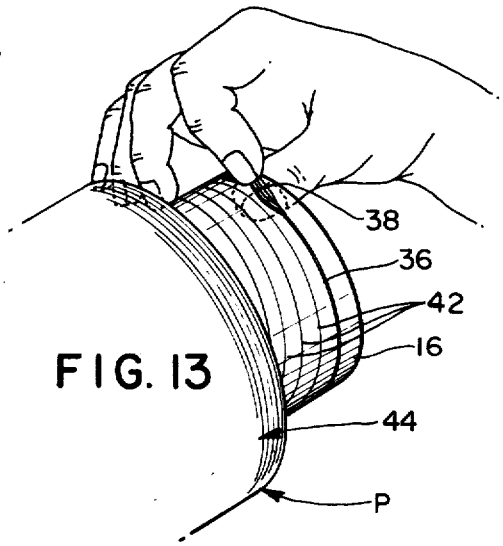
FIG. 13 is a partial perspective showing removal of the strand bunch.
Figure 14:
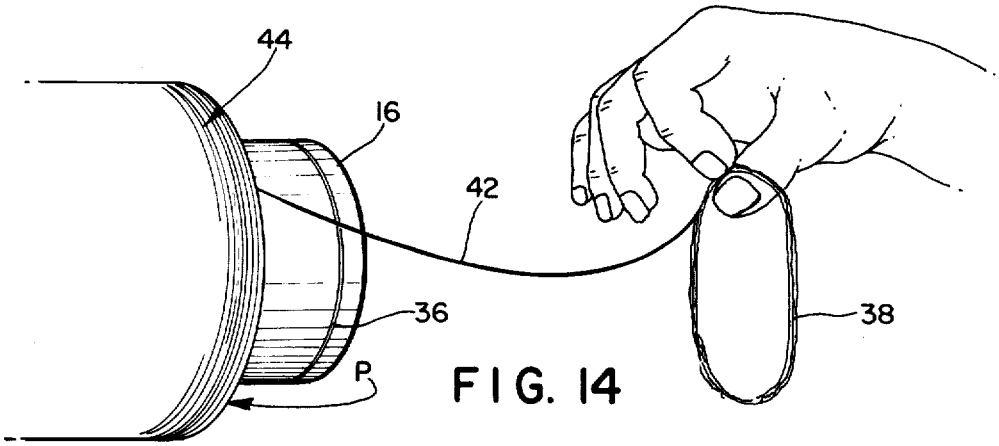
FIG. 14 is a partial perspective view showing the strand bunch removed and exhibiting the tailing end removed from the package support.

Package support 16 is as best shown in FIGS. 10 through 14 of the drawings, provided with a slit 36 which is of generally V-shaped cross sectional configuration and adapted to catch or grasp a strand S therein preliminary to forming a bunch 38 so that the strand end will not become loose when subjected to the high centrifugal forces produced by the package P during winding. The slit 36 as is best shown in FIG. 12 of the drawings is not entirely circumferential. That is a discontinuity 40 in the form of a continuation of the overall surface portions of the support 16 is provided so that the slit is interrupted by a minor arcuate segment. Accordingly a bunch wound thereon may more easily be removed by an operator as depicted in FIG. 13 of the drawings by dragging his or her fingernail across the surface of the remaining arcuate segment of the package support 16. Bunch removal can also be effected by cutting through the bunch at the discontinuity 40 by means of a blade or hot air knife to form separate parts which more easily can be unwound or dug out of the slit 36. Such configuration in the surface of the package support 16 better enables removal of the bunch 38 from the slit 36 and thus gain more immediate access to the tailing end 42 comprised of a plurality of helically wound wraps about the support surface intermediate the slit 36 and the main body 44 of strand wound thereon.

Figure 2:
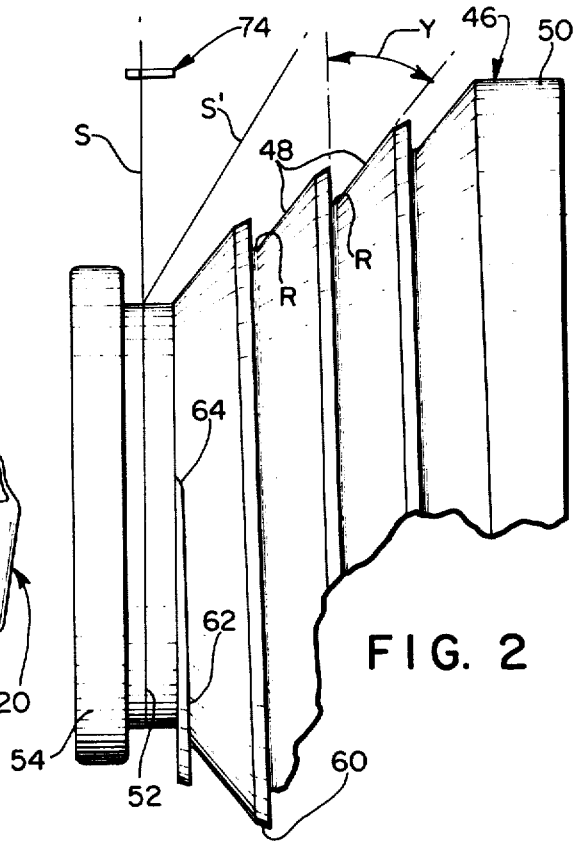
FIG. 2 is an enlarged scale side view of a portion of the tailing hub of the present invention.
Figure 7:
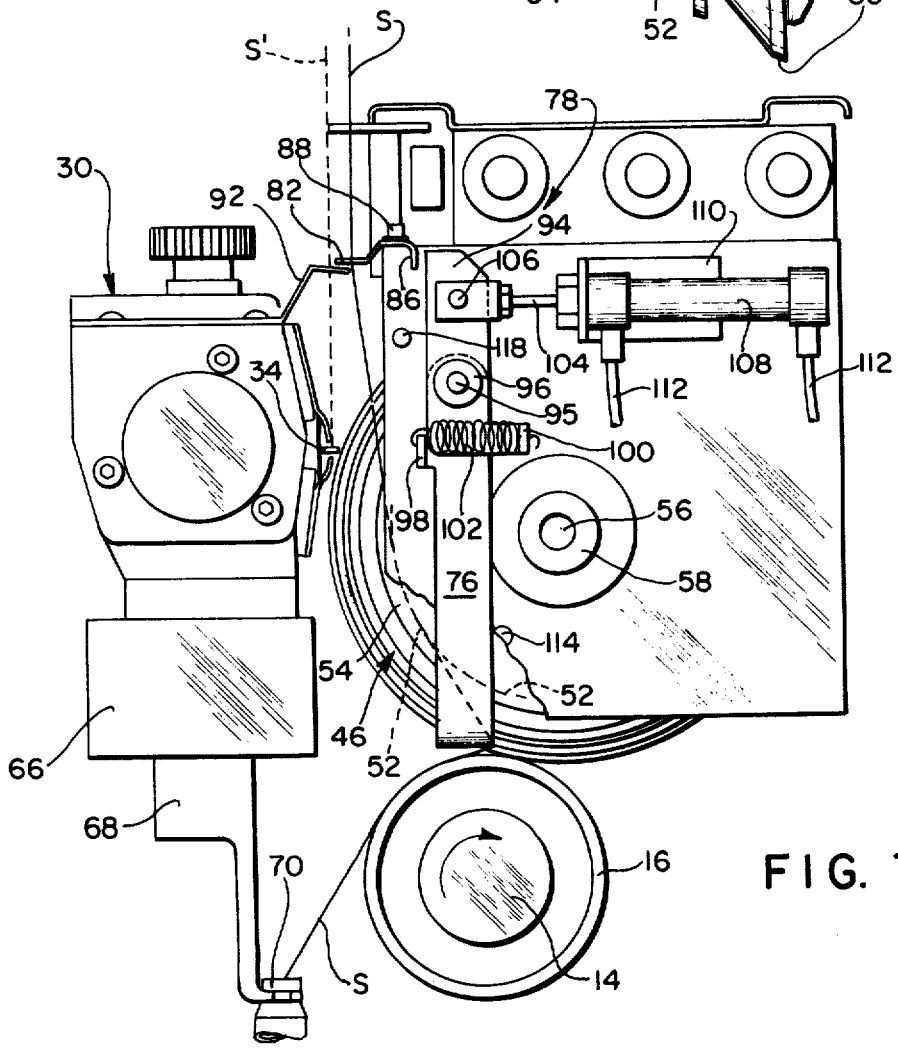
FIG. 7 is an end view of the winding machine shown in FIG. 1 of the drawing.

Referring now to FIGS. 1, 2 and 7 particularly of the drawings, the outward end of the drive roll is provided with a tailing hub 46 of generally frusto-conical cross sectional configuration and having a continuous spiral groove 48 formed in outer portions thereof and connecting the driving surface 50 thereof with a cylindrical shaped hub extension exhibiting a flat groove or surface 52 having in turn a strand retaining barrier 54 outwardly extending therefrom. The tailing hub 46 and the drive roll 24 are supported for rotation about shaft 56 by bearing means 58 suitably secured within the end wall 23.

The surface of each turn of the spiral groove 48 of the tailing hub 46 is upwardly disposed and an angle Y which is somewhat and preferably substantially greater than one half the included conical angle of the hub so that strands, as will hereafter more clearly be brought out, caught within each such turn of the groove will be forced into the root sector R thereof. This enables the strand to be better retained therein as the strands ride up the spiral groove and ultimately to the exterior surface 50 of the drive drum 24 from where it is able to be picked up by the traverse head 34 as best depicted in FIG. 7 of the drawings. The movement of the strand S from the flat bunch forming surface 52 onto to the spiral groove 48 is initiated by a lateral shift of the strand path to a position S′ as shown in phantom lines in FIGS. 2 and 7 of the drawings and thence around the outer surface 50 of the drive drum from where it is printed on the rotating package to form the main body 44 of strand wound thereon. Such shift in the strand path is accomplished by the release of the strand from an upper strand engaging guide vertically aligned with the flat cylindrical surface 52 which cooperatively hold the strand in a bunch forming mode until it is permitted to laterally shift.

The outer edges of each turn of the groove 48 are provided with chamfered portions 60 preferably machined at the same angle as the overall conical configuration of the drum 46. A ramp 62 of increasing diameter initiated from a point 64 in contact with the cylindrical surface 52 and increasing in width to the point where it merges into a full circumferential turn of the groove 48 is formed within the tailing hub 46 to provide for the transition of strand contact from groove 52 to groove 48.

Figure 3:
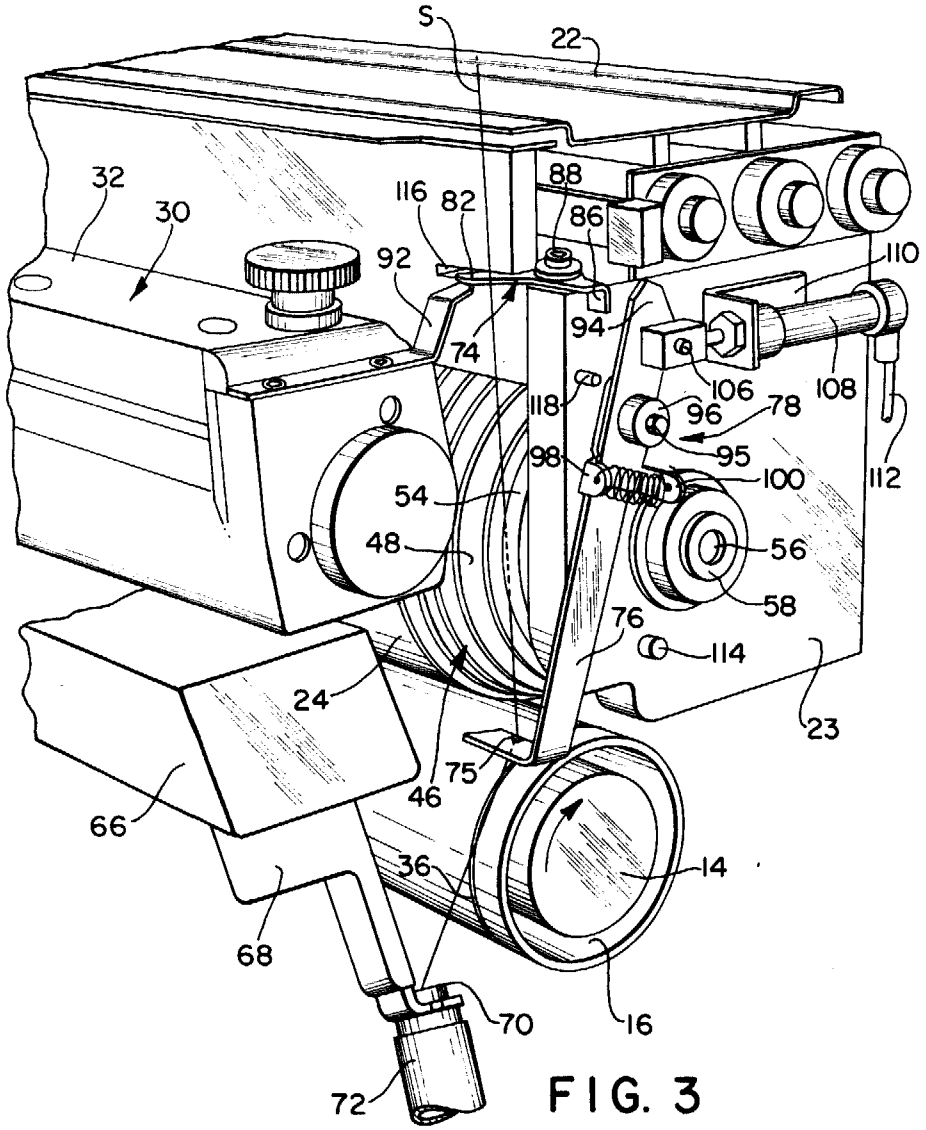
Figure 8:
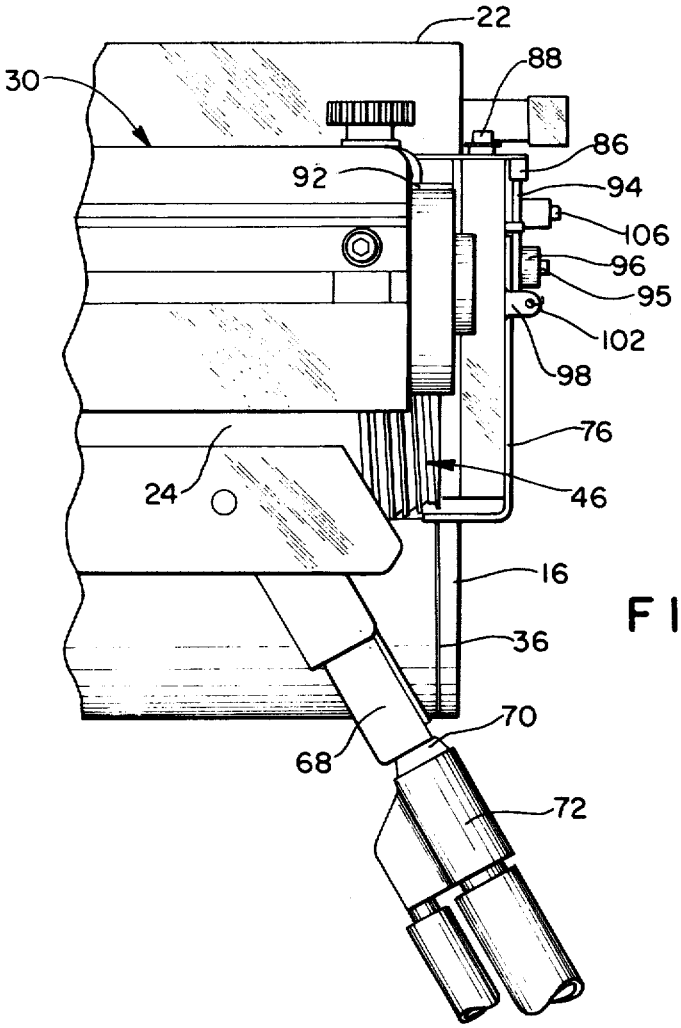
FIG. 8 is a partial side view thereof.
Figure 9:
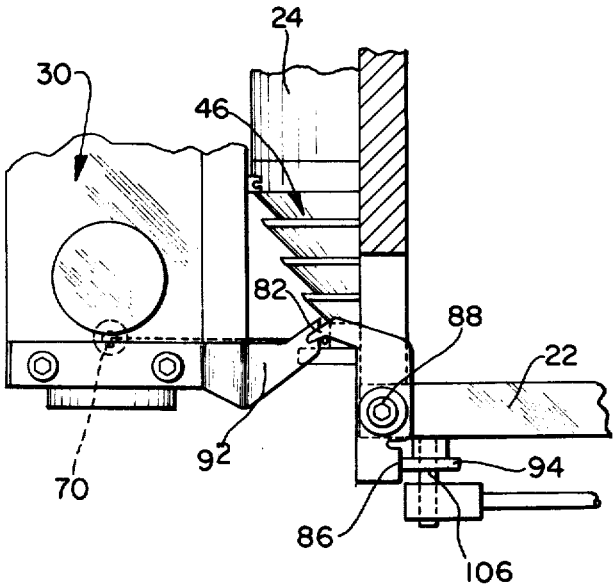
FIG. 9 is a partial top view thereof.
Figure 10:
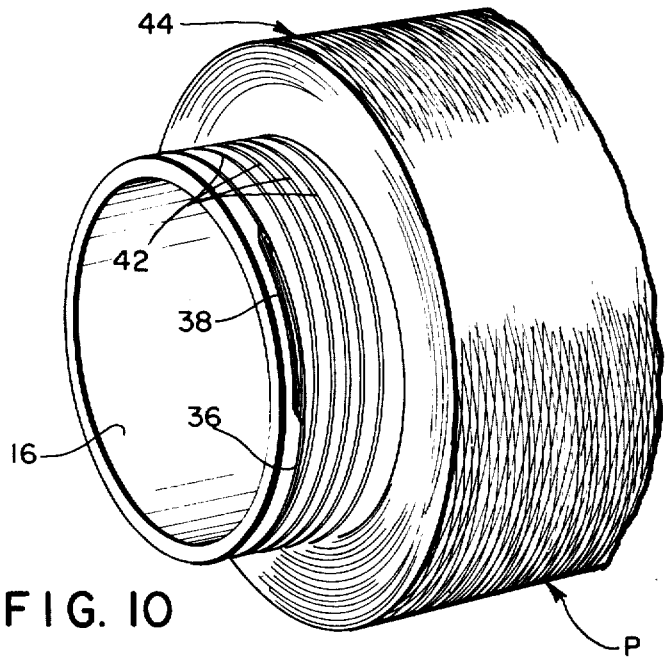
FIG. 10 is a partial perspective view on an enlarged scale of the novel package formed by the winding machine of the present invention.
Figure 11:
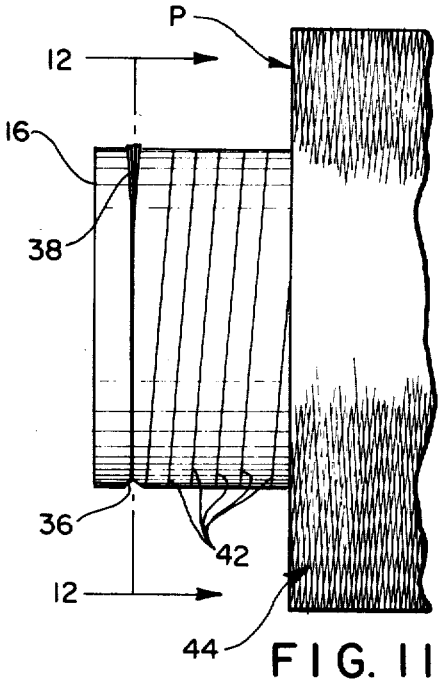
FIG. 11 is a partial side view thereof.

The bottom of the traversing means 30 includes a housing 66 in which a bracket 68 is retained for outward pivotal movement to the position as depicted in FIG. 8 of the drawings for positioning an aspirator opening 70 of an aspirator 72 in line laterally with the slit 56 of the package support 16. The initial non-winding moving path of strand is best shown in FIG. 3 of the drawings wherein a strand S coming from a spinerette or the like is caught in by the hand held aspirator prior to its positioning the bracket 68. With the excess strand being removed by the aspirator, the strand is placed in contact with upper strand engaging or retaining means 74 and thereafter into the strand receiving notch 75 of an injector arm 76 of yarn injector means 78 and thereafter to its bracket held position as previously discussed. In such commonly referred to "threaded up position" of the strand path; that portion of the upper strand retaining means 74 contacting the strand, notch 75 of the strand injector system in contact with the strand, and the aspirator opening 70 are substantially in a common plane disposed generally normal to the longitudinal extent of the winding machine. The slit 36 as so falls within such plane so that when the yarn injector mechanism 78 is activated so as to force the strand into contact with the rotating package support 16, the strand will be forced into the slit 56, caught thereby and wound for one or more revolutions to form the bunch 38. Thereafter after release of the strand S by the upper strand retaining means the strand is free to move up the spiral groove 48 to form the tailing end 40.

The upper strand engaging or retaining means 74 comprises a plate 80 having first 82 and second 84 outwardly extending arms therefrom. The arm 82 is of inwardly hooked configuration to better grasp strand received thereby and the arm 84 is provided with a downwardly extending pad 86 for engagement with portions of the strand injector system 78 as will hereinafter be more fully explained. The plate 80 is pivotally connected to the support 23 by means of shaft 88 and retaining means 90. Additionally as an aid to initial threading up, a guide 92 is positioned slightly forward of the hooked finger 82 to better lead the strand thereinto. The guide 92 may be suitably affixed to the traverse means 30 as depicted.

Figure 6:
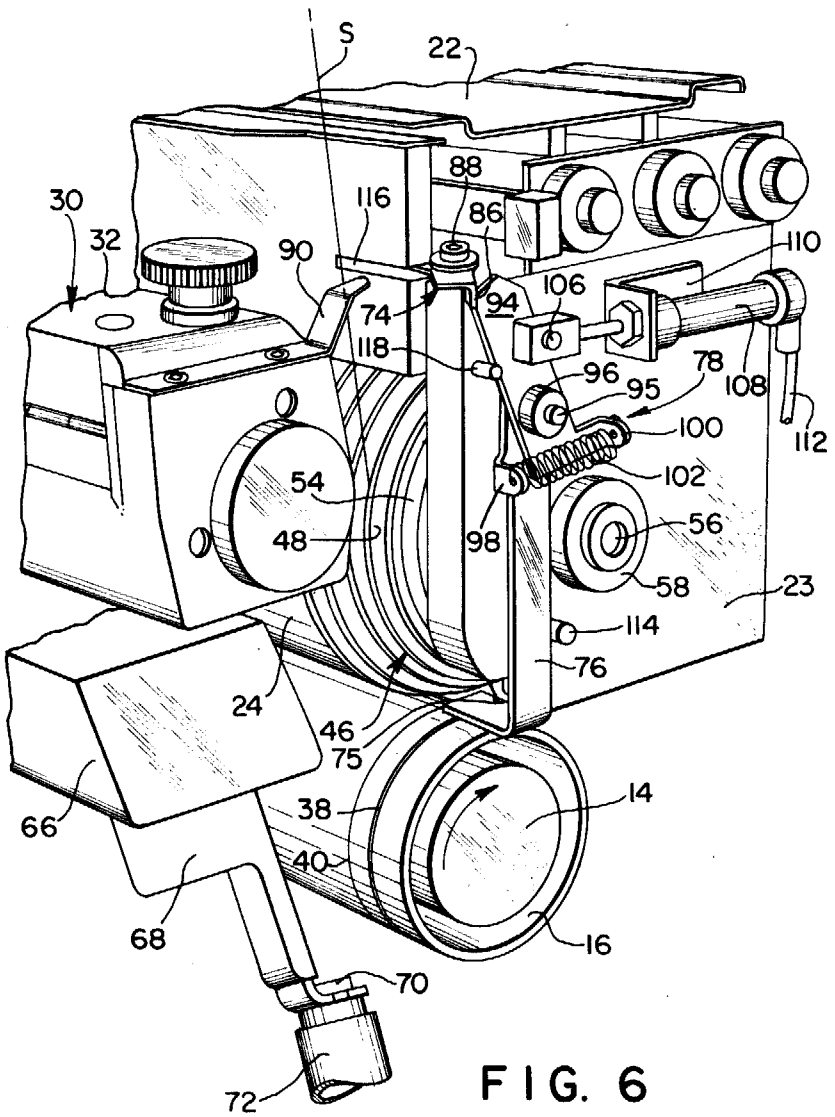

Yarn injector means 78 includes said afore-mentioned yarn injector arm 76 and its yarn engaging groove or notch 75. A second arm or extension 94 separate from arm 76 is pivotably connected thereto by a hinge pin 95 received in boss 96. The arm 76 includes an outwardly offset tab extension 98 as best seen in FIG. 6 of the drawings and the arm 94 includes an outwardly offset tab 100. The tabs 98 and 100 are held together by spring member 102 so that the arms 76 and 94 operate as a single unit until the tension of spring 102 is overcome at which point they are able to operate separately. The upper arm 94 above the pivot pin 95 thereof is connected to a piston 104 by means of a pin connection 106. The piston is in turn part of an air cylinder 108 connected to the support 23 by means of an L-shaped bracket 110 and provided with suitable air lines 112.

Figure 4:
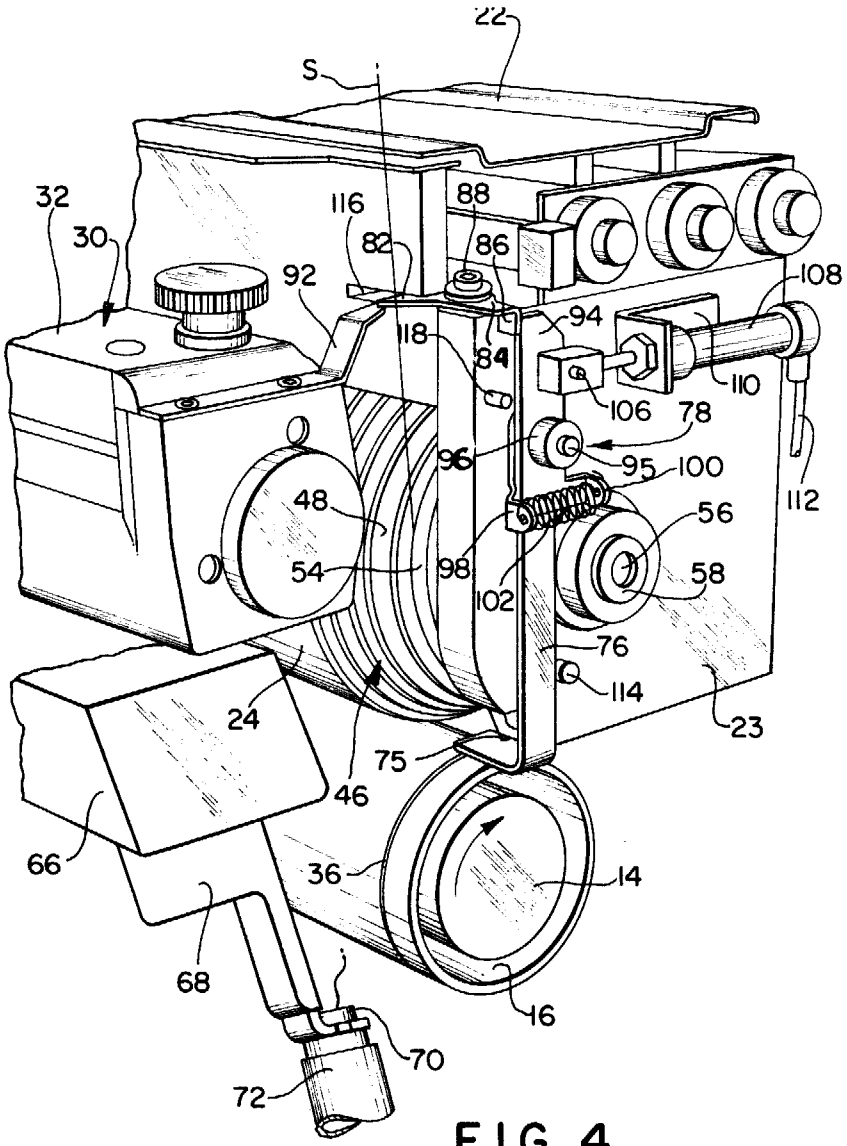
FIGS. 3 through 6 are partial perspective views of the winding machine of the present invention in sequential operational modes showing respectively (3) the strand in a non-winding position, (4) the strand initially forced into contact with the package support by the yarn injector arm, (5) the yarn path in contact with the circular groove for forming a bunch and (6) the strand path moving up the spiral groove in the tailing hub to form a tailing end between the bunch and the axial portion of the support wherein the main body of strand is wound.
Figure 5:
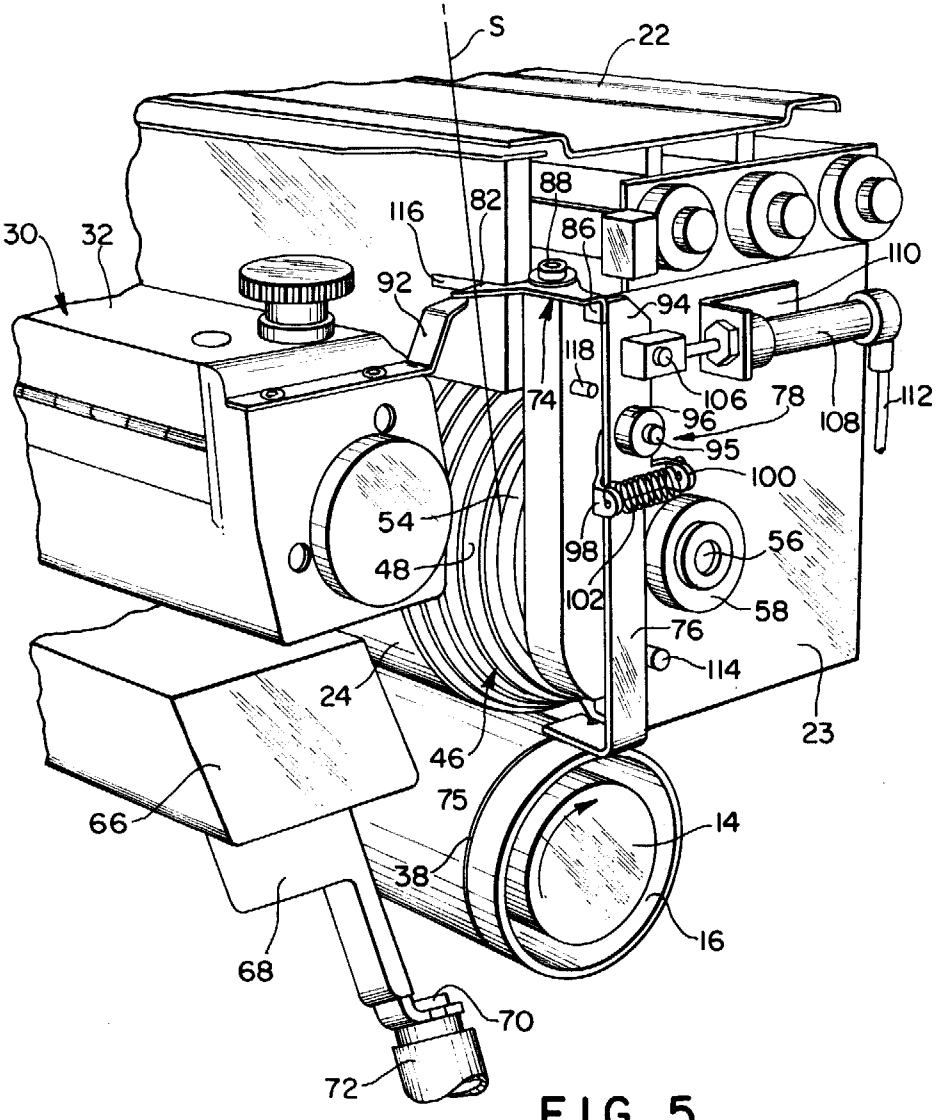

The arms 76 and 94 operate as a single unit in the operative positions of the device as shown in FIGS. 3, 4 and 5 of the drawings. However, when the arm 76 is engaged with a stop 114 in a forward motion of the piston 104 activated as by an operator depressing one of the panel buttons B depicted, the arm 94 is independently pivoted about pin 95 to the left as shown in the transition between FIGS. 5 and 6 of the drawings into contact with the tab 86 of the strand retaining means 74 so as to inwardly pivot the yarn engaging finger 82 within a slot 116 formed in the drive means housing 22 so as to release the strand and enable such to assume a position between a spinnerette or conventional upper guide means (not shown) and its contact with surface 52 of the tailing hub 46. The forward movement of the arm 94 is stopped by its interaction with a stop pin 118 and thereafter permitted to return to a position in line with arm 76 and thence to initial threaded up position as best shown in FIG. 3 of the drawings by suitable conventional valve and actuation means contained within the operative panel and sequenced by actuation of one of the buttons B.

The operational sequence of the tailing device will now be explained by reference to FIGS. 3 through 6 of the drawings and FIG. 2 thereof. As previously indicated FIG. 3 shows the strand path in an inactive moving position whereby waste excess yarn is received by the aspirator. The strand is furthermore positioned in substantial alignment with the slit 36 of the package 16 by means of its coaction with upper strand guide means 74 and lower strand guide means formed by the notch 75 in the strand injector arm 76. In such position both the drive 24 and the package support 16 may be at operative winding speeds. Thereafter upon actuation of one of the buttons B, the piston 104 is forced to the left thus in turn forcing the injector arm 76 to the right to the extent permitted by stop 114 so that the strand sequentially initially contacts the cylindrical groove 52 of the tailing hub 46 and thereafter the rotating package 16.

It should also be brought out that the combination of a positive yarn injector and the inclusion of a generally conical tailing hub enables the strand S to be first placed on the rotating support 16 at a position proximate to its nip with driving roll 24. Thus such initial contact may take place high up on the support at 10 to 12 o'clock positions as best shown in FIG. 7 of the drawings and accordingly reduce the amount of strand slack produced when the strand is transferred to the support. As soon as the strand is caught in the slit 36, the rotational force of the package 16 snaps that portion of the strand held by the aspirator 70 and winding to form a bunch 38 proceeds.

While the afore-mentioned operative motions are taking place, the piston 104 is continuing to move to the left to a position best shown in FIG. 6 of the drawings wherein the tension of the spring 102 has been overridden and the arm 94 pivoted so as to contact the upper strand engaging means 74 so as to force the strand engaging finger 82 thereof out of engagement with the strand so as to permit the strand to assume a position more inwardly disposed towards the center of the traversing means 30. Such motion is represented by the transition between the solid strand path S and that shown in phantom S′ as in FIGS. 2 and 7 of the drawings. It should be emphasized that such redisposition of the strand path enables the strand to move from its contact with the rotating cylindrical surface 52 initially into the ramp 64 and thence to the continuous spiral groove 48. The rotation of the tailing hub 46 continues to force the strand into each separate turn of the groove 48. The upward slope of the groove surface assures that the strand is forced into the root R thereof where it is held from running over the edges thereof by the shoulder portion of the previous turn of the groove. As the rotation of the tailing hub forces the strand upwardly along the groove 48, each full turn thereof in effect prints a strand wrap of known length proportional to the ratio of cone groove pitch prorated to the diameter of the package support 16. Such motion continues until the strand rides up onto the main surface 50 of the drive drum at which time it is free to be caught by the traverse head 34 and thus traversed back and forth axially along the package to build the main body 44 thereof.

Inasmuch as each turn of the spiral groove is greater in diameter than the proceeding turn, the slack produced in the strand by its transition from its position held by injector arm 76 to its position within the slit 56 and about the rotating package support 16 is progressively taken up as the strand moves from its initial bunch forming position to its main package winding position. In prior art devices this tension change caused by such slack is sometimes not achieved until several traverses of the main strand body has taken place. In the present device not only is this slack minimized by the high initial strand placement on the support 16 but such minimum slack is further equalized almost immediately and prior to main strand body winding by the present invention.

In this way then, it is clear that by regulating the helix angle of the spiral groove and accordingly the number of complete turns made from the base thereof to the full diameter extent of the drive drum, determines the length of the strand that will be wound onto the package support 16 to form a tailing end 40. It should be brought out that since the equivalent linear distance of the spiral groove determines the amount of tailing end printed onto the package support 16 and that since such is of a predetermined extent for each particular spiral configuration tailing hub, that the tailing end produced thereby will be of essentially equal length each time the operation is repeated in winding successive packages. This length is furthermore not dependent either upon the speed or tension at which the yarn is operating while producing such tailing end and accordingly is not subject to varying length production as in prior art devices. Furthermore as the successive turns of the spiral groove are equidistant from each other, the spacing of the helically turns wound about the support will also be generally equidistant from each other. In other words such spacing will not be subject to variations or even overlap due to variations in strand tension or winding speed.

An operational theory of the foregoing invention follows and while believed to be accurate the invention should in no way be construed as being limited thereby: It is believed that the surface speed of the strand relative to the surface of the groove turns is an important factor in the operation of the present device. Tests have shown that if the strand speed is considerably higher than the groove surface speed, the strand, even though delivered to the groove at an appreciable angle, will slide down the sides of the groove and stay in the groove bottom. As the groove diameter increases (due to the spiral groove having been cut on a cone) and approaches full drive roll diameter, a point is reached when the surface speed of the groove and the yarn speed approach each other and the strand climbs out of the groove and is inwardly directed towards the package center where it is picked up by the traverse guide 34.

The exact point at which the yarn climbs out of the groove is immaterial since an adequate tail will have already been made prior to reaching it. The point of "climb-out" can be observed sufficiently well so that the number of turns of tail on the package and accordingly the length thereof can be preselected with the pitch of the spiral groove. The remaining portion of groove beyond the "climb-out" point on the large diameter end of the cone assures transfer if the point of "climb-out" changes due to strand variables.

It should be understood that variations and modifications and special adaptations of the embodiments of the present invention may be utilized without departing from the scope of the present invention as set forth in the following claims.

What is claimed is:

1. Apparatus for winding an advancing strand into a package comprising, strand take-up means mounted for rotation, strand traversing means for guiding said strand to said take-up means to wind the strand into a package thereon, drive means for contacting the surface of said take-up means and sequentially the surface of the package thereon to rotate said take-up means and said package, conical tailing means mounted on said take-up means for rotating therewith, said tailing means having a spiral groove formed therein, said groove being engageable with said strand to wind the strand into a strand tailing end of predetermined length on a predetermined section of said take-up means, the linear length of said groove being essentially equal to said predetermined length.

2. Apparatus as set forth in claim 1 wherein said groove has a surface which is upwardly sloped, the included angle of said sloped surface being greater than one-half the included angle of said conical tailing means.

3. Apparatus as set forth in claim 1 wherein said spiral groove includes a plurality of generally helical wraps around said tailing means.

4. Apparatus as set forth in claim 3 wherein said spiral groove terminates at one of its ends in a circular groove having a flat cylindrical surface.

5. Apparatus as set forth in claim 4 including an inclined ramp connecting said circular groove with said spiral groove.

6. Apparatus as set forth in claim 4 including injector means for moving said advancing strand from a non-winding position wherein the strand path is aligned but laterally offset from said circular groove into sequential contact with said circular groove and thereafter with said take-up means.

7. Apparatus as set forth in claim 6 including strand engaging means for directing said strand in its non-winding position, and means for collecting said moving strand when said strand is advanced in its non-winding position.

8. Apparatus as set forth in claim 7 wherein said collecting means is an aspirator.

9. Apparatus as set forth in claim 7 wherein said strand engaging means includes a strand guide, said strand guide being aligned with said circular groove.

10. Apparatus as set forth in claim 6 wherein said injector means includes separate first and second arms spring urged together in longitudinal alignment, said second arm being connected above said first arm for pivotal movement therewith when said spring force is overcome.

11. Apparatus as set forth in claim 10 wherein said first arm has a tab outwardly extending from one side thereof, said second arm having a tab outwardly extending therefrom and opposed to said first arm tab, and a spring connected to intermediate of said tabs.

12. Apparatus as set forth in claim 1 including injector means for moving said strand into initial contact with said rotating support.

13. Apparatus as set forth in claim 12 wherein said injector means includes a first arm having a laterally offset generally flat blade with a strand engaging slot therein, said blade being adapted for disposition beneath said tailing hub in its yarn injecting position.

14. Apparatus as set forth in claim 9 wherein said strand engaging means including a pivotably mounted plate having spaced arms extending therefrom, one said arm being adapted to contact said strand, the other said arm being adapted for contact by said injector means to pivot said plate and accordingly release said strand held by said first arm.

* * * * *